United States Patent [19]

Eguchi et al.

[11] 3,973,508

[45] Aug. 10, 1976

[54] SEWING MACHINE ZIPPER FOOT

[75] Inventors: Yasukata Eguchi, Kunitachi; Susumu Hanyu, Hachioji, both of Japan

[73] Assignee: Janome Sewing Machine Co. Ltd., Tokyo, Japan

[22] Filed: Dec. 9, 1974

[21] Appl. No.: 531,007

[30] Foreign Application Priority Data

Dec. 11, 1973 Japan ..... 48-140595[U]

[52] U.S. Cl. ..... 112/240

[51] Int. Cl.[2] ..... D05B 29/00

[58] Field of Search ..... 112/240, 235, 60, 61

[56] References Cited

UNITED STATES PATENTS

| | | | |
|---|---|---|---|
| 3,294,048 | 12/1966 | Micale | 112/240 |
| 3,326,160 | 6/1967 | Murino | 112/240 |
| 3,724,407 | 4/1973 | Simon | 112/240 |
| 3,854,433 | 12/1974 | Hanyu | 112/240 X |

*Primary Examiner*—Werner H. Schroeder
*Assistant Examiner*—Peter Nerbun
*Attorney, Agent, or Firm*—Michael J. Striker

[57] ABSTRACT

A supporting member is removably attached to an upright presser bar of a sewing machine, and a zipper foot is attached to the supporting member so as to be removable therefrom. The position of the zipper foot on and with reference to the supporting member can be changed in direction transversely of the upright presser bar of the sewing machine, to thereby make it possible to move the zipper foot to positions in which the sewing machine can be used to sew a zipper, and to a position in which the sewing machine can be used for other work not involving the sewing of a zipper; this eliminates the need for removing the zipper foot at such times when the machine is not used to sew a zipper.

4 Claims, 7 Drawing Figures

SEWING MACHINE ZIPPER FOOT

BACKGROUND OF THE INVENTION

The present invention relates in general to a sewing machine, and in particular to a zipper foot for use with a sewing machine.

A zipper foot is a device that is used on a sewing machine whenever the machine is to be employed to sew a zipper into a garment or the like. Conventionally, the zipper foot is composed of the actual foot and a supporting member that is integral with the foot and which is releasably securable to the upright presser bar of the sewing machine. Whenever the machine is to be used to sew a zipper in place, the zipper foot is installed on the presser bar; however, because the zipper foot interferes with the use of the machine for applications other than sewing a zipper, for example for merely sewing a conventional seam, it is necessary to remove the zipper foot with its supporting member for the presser bar whenever the machine is to be used for any application other than sewing of a zipper. The zipper foot is then replaced with a presser foot that is connected to the presser bar.

The necessity for frequently exchanging the usually employed presser foot with the zipper foot, and vice versa, is troublesome and time consuming, especially in industrial applications, because the time loss involved of course results in a decrease of the sewing efficiency. This is particularly true because it is absolutely necessary whenever the zipper foot is employed, to so adjust the zipper foot with respect to the needle hole of the throat plate when it is installed on the pressure bar, that the needle will be able to operate properly. This adjustment is the primary reason for the time-consuming installation. Any error in installing the zipper foot may cause breakage of the needle and/or improperly formation of stitches.

SUMMARY OF THE INVENTION

It is therefore a general object of the present invention to overcome the aforementioned disadvantages.

More particularly, it is an object of the invention to provide an improved zipper foot arrangement which is not possessed of these disadvantages.

An additional object of the invention is to provide such an improved zipper foot which can be readily attached to and removed from a supporting member, and which latter in turn can be secured to the presser bar of a sewing machine.

A further object of the invention is to provide an improved zipper foot which can be adjusted relative to the supporting member in respective predetermined positions so that both sides of the zipper, that is the two tapes of the zipper, can be readily sewn in place.

An additional object of the invention is to provide such an improved zipper foot which need not be removed, even when the machine is used for applications other than sewing a zipper in place.

In keeping with these objects, and others which will become apparent hereafter, one feature of the invention resides, in a sewing machine having a presser bar, in a combination which comprises a supporting member that is adapted to be mounted on the presser bar of the machine, a zipper foot, and connecting means which adjustably connects the zipper foot with the supporting member.

The invention makes it possible to shift rapidly and simply from normal sewing to zipper sewing, and back, without requiring the removal of the zipper foot at any time for normal sewing, or requiring installation of the zipper foot for zipper sewing. All that is required is a simple adjustment in the position of the zipper foot.

However, if for any reason it is desired to replace the zipper foot with a conventional presser foot, then the present invention still makes this possible in a simple manner because the zipper foot can be attached to and detached from the supporting member which itself can remain in place on the presser bar. A further advantage of the present invention is that the novel zipper foot is capable of cooperating with the feed dogs of the sewing machine, in order to properly and positively feed the stitched zipper, and thereby to raise the sewing efficiency.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
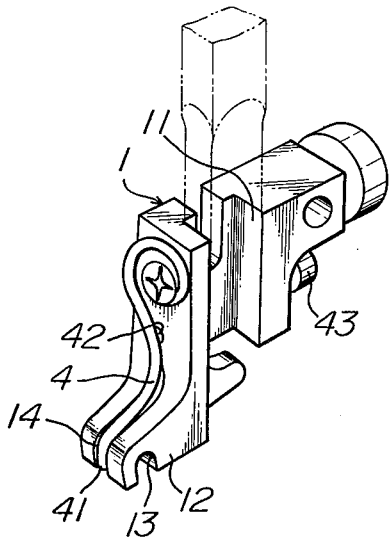
FIG. 1 is a perspective view, illustrating a zipper-foot supporting member which is a part of the device according to the present invention.
Figure 2:
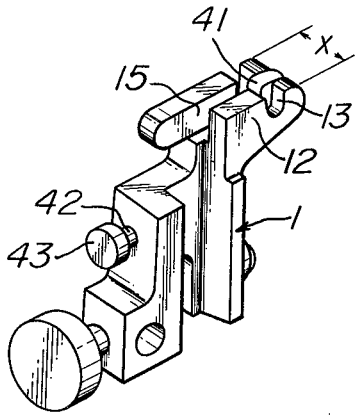
FIG. 2 is a bottom perspective view of FIG. 1.

Referring firstly to FIGS. 1 and 2 it will be seen that reference numeral 1 identifies a supporting member having a portion 11 by means of which it is mounted on a vertically oriented presser bar of a sewing machine. The sewing machine itself is not illustrated because it is not needed for an understanding of the invention. A portion of the presser bar is shown in phantom lines. The supporting member 1 has a lower free end portion 12 having a transverse width X (see FIG. 2) and being formed in a surface which in operation faces downwardly (i.e. towards the material being sewn) with a groove 13 extending across the width, that is transverse to the vertical orientation of the presser bar. The portion 12 has an additional groove 14 (compare FIG. 1) a lower end of which extends to and is open at the surface in which the groove 13 is formed. A spring 4 is mounted on the supporting member 1 as shown and has a hook-shaped lower end portion 41 which is lodged in the groove 14 and which in part extends transversely across the groove 13. A pin 42 is mounted in the supporting member 1 and can be shifted axially of itself by exerting pressure upon its exposed head 43; when this is done, the free end portion of the pin 42 presses against the spring 4 (see FIG. 1) and deflects the spring so that the hook-shaped end portion 41 of the spring is deflected transversely of and out of the groove 13, as a comparison of FIGS. 1 and 2 clearly shows. This retraction of the end portion 41 from the groove 13 will, of course, last only as long as pressure is maintained on the head 43 of the pin 42. A further groove 15 is also formed on the same surface in which the groove 13 is formed, but extends in direction normal to the elongation of the groove 13, i.e. in the direction in which the material being sewn is to be fed.

Figure 3:
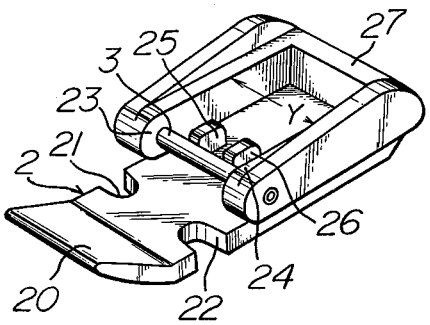
FIG. 3 is a perspective view, illustrating a zipper foot according to the present invention, for use with the supporting member in FIGS. 1 and 2.

The zipper foot 2 which together with the supporting member 1 of FIGS. 1 and 2 constitutes an assembly, as illustrated in FIG. 3. It has a base plate 20 that is formed in its opposite lateral edges with recesses or needle holes 21, 22; these are open in outward direction of the lateral edges. An upper surface of the base plate 20 has provided on it a frame 27 having two transversely spaced side walls 23 and 24. A pin 3 is firmly mounted in the side walls 23 and 24 and extends from one to the other thereof across the width of the space located between the side walls, which width is identified with reference character Y. This width is substantially in excess of the dimension X of the supporting member 1.

Figure 4:
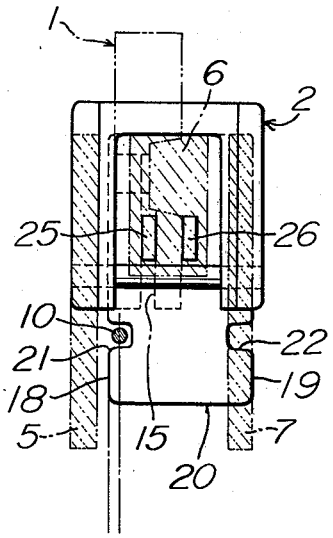
FIG. 4 is a partly sectioned top view of the top plan view of the device of the present invention, showing the zipper foot of FIG. 3 installed on the supporting member of FIGS. 1 and 2 and illustrating the zipper foot in one adjusted position.
Figure 5:
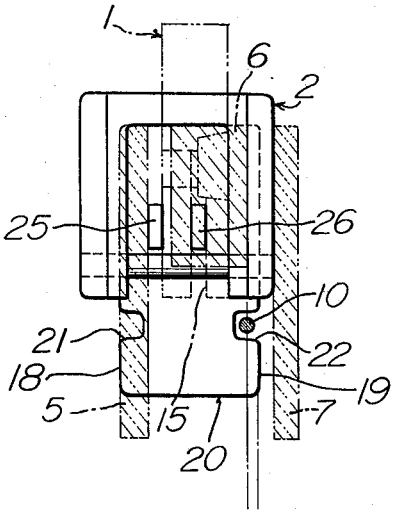
FIG. 5 is similar to FIG. 4, but showing the zipper foot in another adjusted position.

A pair of upright projections 25 and 26 are fixedly arranged in spaced relation on the upper surface of the base plate 20, inwardly of the side walls 23 and 24 and rearwardly of the pin 3. The transverse thickness of the projections 25 and 26 correspond substantially to the width of the groove 15, and the projections 25 and 26 are intended to be respectively introduced into this groove 15 to thereby position the zipper foot 2 in one or another predetermined lateral position relative to the supporting member 1, that is in a rightwardly displaced position or a leftwardly displaced position. The base plate 20 also has guide edges 18 and 19 on the opposite lateral sides, as shown in FIGS. 4 and 5.

To secure the zipper foot 2 to the supporting member 1 it is merely necessary to so position it that the groove 13 receives the pin 3, for which purpose the pin 43 is depressed to retract the end portion 41 of the spring 4 out of the groove 13. Once the pin 3 is received in the groove 13, pressure on the pin 42 is released and the end portion 41 of the spring 42 moves back across the groove 13 and now retains the pin 3 in this groove.

It is one of the important advantages that the connection between the foot 2 and the supporting member 1 may be maintained at all times, except possibly for brief adjusting periods, whether or not a zipper is to be sewn onto the garment or other article. In other words, when no zipper is to be sewn, then the foot 2 will assume a certain position with reference to the supporting member 1, and when a zipper is subsequently to be sewn, then it is merely necessary to change the position of the foot 2 relative to the supporting member 1 slightly and in a very simple manner, as will be described subsequently.

When a basic seam S or S′ is to be stitched, the foot 2 is merely so shifted —after first disconnecting it from the supporting member 1 and inserting one of the upright projections 25 or 26 in the groove 15 of the supporting member 1— that the guide edges 18 and 19 of the base plate 20 are properly located, these guide edges serving either for the right or for the left hand stitching in a zigzag sewing machine.

FIGS. 4 and 5 show how the foot 2 is arranged when a zipper is to be stitched in place on a garment or the like. It is clear that in FIG. 4 the projection 25 is received in the groove 15, whereas in FIG. 5 the projection 26 is received in the groove 15.

Figure 6:
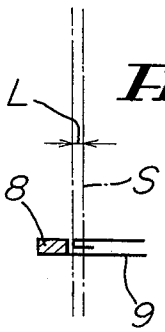
FIG. 6 is a cross sectional view, illustrating a zipper being stitched on a garment by use of the device according to the present invention, with the zipper foot being in the adjusted position shown in FIG. 4.
Figure 7:
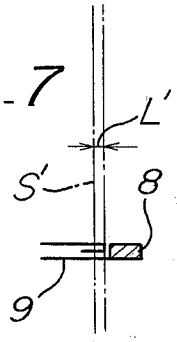
FIG. 7 is a view similar to FIG. 6, but showing the zipper being stitched in place with the zipper foot adjusted to the position of FIG. 5.

FIG. 4 shows the position of the zipper foot 2 when the tape 9 at the right-hand side of the actual zipper mechanism 8 is to be stitched (compare FIG. 6), whereas FIG. 5 shows the position of the zipper foot 2 when the tape 9 to the left-hand side of the zipper mechanism 8 is to be stitched (compare FIG. 7). The basic needle lines in FIGS. 4 and 5 are inwardly spaced from the corresponding guide edges 18 and 19 by the distance L or L′, so as to stitch portions of material (i.e. the tape 9) which are laterally spaced from the actual zipper mechanism 8. Reference numerals 5, 6 and 7 represent feed dogs of the sewing machine. In FIG. 4, the feed dog 5 is located beneath the zipper 8 while the feed dogs 6 and 7 are located under the base plate 20. In the adjusted position of the zipper foot 2, one side of the zipper is being stitched, whereas in FIG. 5 the feed dogs 5 and 6 are located under the base plate 20 and the feed dog 7 is located under the zipper 8 so that in this position of the zpper foot, the other side of the zipper 8 is being stitched.

If for any reason a disengagement of the zipper foot 2 from the member 1 is desired, for example to permit connection of a differnet foot which might be required for a different sewing operation, this can be readily and rapidly carried out in the manner described earlier. The device of the invention may be made of metal or synthetic plastic material, for example by die casting or the like.

The principle of the invention can be applied to a straight stitching sewing machine as well as to a zigzag sewing machine.

This invention has been applied to a zigzag sewing machine stitching with the maximum width of about 7 mm which is presently and generally available. This principle of invention, however, could be applied to a zigzag sewing machine stitching with larger maximum width of about 10 mm. In such an instance, it will be apparent that the base plate 20 of zipper foot 2 is made wider in accordance with the more widely spaced arrangement of feed dogs 5 and 7 of the zigzag machine, and that the upright projections 25, 26 are accordingly arranged in more spaced relation to each other. In this widened space between the projections on the upper side of base plate 20, at least additional projection just like the projections 25, 26 can be provided, so that the projection may be inserted into the groove 15 of supporting member 1. In such a manner, it will also be apparent according to the present invention that the needle positions for sewing a zipper onto the garment or the like can be more variously selected with respect to zigzag sewing machines which could make zigzag stitches of larger maximum width, by providing one or more additional upright projections on the upper side of so widened base plate 20.

It will be understood that each of the elements described above, or two or more together, may also find a useful application in other types of constructions differing from the types described above.

While the invention has been illustrated and described as embodied in a zipper foot for use with zigzag sewing machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sewing machine having a vertically oriented presser bar, a combination comprising a supporting member adapted to be mounted on said presser bar and having an end portion provided with an upright groove and with another groove extending transversely of said orientation; a zipper foot having a shaft also extending transversely of said orientation and receivable in said groove; connecting means adjustably connecting said zipper foot with said supporting member, said zipper foot having a base plate provided on an upper side thereof with a pair of transversely spaced sidewalls, and said shaft extending from one to the other of said sidewalls, the distance between said sidewalls being greater than the corresponding dimension of said end portion so that the latter is receivable with clearance between said sidewalls; and adjusting means for adjustment of said zipper foot relative to said free portion in direction axially of said shaft between at least two positions, including at least two spaced upright projections fixedly arranged on said upper side of said base plate and alternatively receivable in said another groove.

2. A combination as defined in claim 1, wherein said base plate has a transverse dimension wide enough to cooperate with feed dogs of said sewing machine for properly and positively feeding a material to be sewn, and open holes formed on both side edges of said base plate for enabling the needle of the sewing machine to pass therethrough.

3. A combination as defined in claim 1, wherein said supporting member is provided with a spring having a hook-shaped end for engaging said shaft of said zipper foot, to thereby support the same on the supporting member, and a manually operated pin axially shiftable to press against said spring for releasing said zipper foot from said supporting member.

4. A combination as defined in claim 1, wherein said adjusting means comprises more than two spaced upright projections fixedly arranged on said upper side of said base plate.

* * * * *